252-99 AU 165 EX
XR 3,957,661

United States Patent [19]
Vérité

[11] 3,957,661
[45] May 18, 1976

[54] FABRIC SOFTENING LAUNDRY DETERGENT CONTAINING ORGANIC ESTERS OF PHOSPHORIC ACID

[75] Inventor: Claude Vérité, Paris, France

[73] Assignee: Colgate-Palmolive Company, New York, N.Y.

[22] Filed: July 13, 1973

[21] Appl. No.: 378,879

[30] Foreign Application Priority Data

| | | |
|---|---|---|
| July 25, 1972 | France | 72.26684 |
| July 25, 1972 | France | 72.26685 |
| July 25, 1972 | France | 72.26683 |

[52] U.S. Cl. ..... 252/8.9; 252/89 R; 252/135; 252/539; 252/540

[51] Int. Cl.[2] ..... C11D 1/34; C11D 1/83; C11D 1/08; D06M 13/32

[58] Field of Search ..... 252/8.9, 89, 135, 539, 252/540

[56] References Cited

UNITED STATES PATENTS

| | | | |
|---|---|---|---|
| 3,001,945 | 9/1961 | Drew | 252/539 |
| 3,366,571 | 1/1968 | Cooper | 252/99 |
| 3,703,480 | 11/1972 | Grand | 252/524 |
| 3,738,943 | 6/1973 | Kaneko | 252/540 |

FOREIGN PATENTS OR APPLICATIONS

| | | | |
|---|---|---|---|
| 7,003,103 | 9/1970 | Netherlands | 252/8.9 |
| 1,300,829 | 12/1972 | United Kingdom | 252/8.9 |

*Primary Examiner*—Dennis L. Albrecht
*Attorney, Agent, or Firm*—John J. Tomaszewski; Murray M. Grill; Herbert S. Sylvester

[57] ABSTRACT

A heavy duty laundry detergent in particulate form which washes well and softens textiles washed with it includes small proportions of mono- and di-higher alcohol polyethoxy phosphate ester salts, a washing proportion of synthetic anionic organic detergent, e.g., alkali metal higher alkyl benzene sulfonate, and supplementing quantities of alkali metal silicate and non-silicate builder salts, with alkali metal sulfate and moisture. Low foaming detergent compositions of this general type, for use in automatic washing machines such as horizontal drum washing machines, also include alkali metal higher fatty acid soap and similarly, low foaming or non-foaming detergent compositions may include a nonionic detergent or a mixture of detergents of the polyethoxylated higher alcohol or polyethoxylated alkyl phenol types and will produce curd-free wash waters. Methods of washing and softening textiles by using such compositions are also described.

16 Claims, No Drawings

FABRIC SOFTENING LAUNDRY DETERGENT CONTAINING ORGANIC ESTERS OF PHOSPHORIC ACID

This invention relates to heavy duty laundry detergents containing mixed organic esters of phosphoric acid. More particularly, the invention is of such compositions which wash and soften textiles and which include salts of mixed mono- and di-organic phosphate esters, anionic synthetic organic detergent and builder salts for the synthetic detergent. In some preferred embodiments of the invention soaps or nonionic synthetic organic detergents of certain types are employed to diminish foaming of the product to a desired extent.

It is well known that textiles and laundry washed with heavy duty synthetic organic laundry detergents often have a "hard" feel after washing. Such materials may be softened somewhat by the repeated flexings accompanying air drying or tumbling in an automatic laundry dryer but consumers generally prefer washed articles to be softer. Because of such preferences there have been marketed various fabric softeners, some of which also function as antistatic agents. Such softeners, among which the quaternary ammonium salts have been prominent, have usually been added to the rinse water after washing has been completed and, because they are substantive to washed textiles, they are taken up by the laundry. The consumer often finds it inconvenient to make a second trip to the washing machine for the purpose of adding a softening compound in the rinse and most washing machines are not equipped with automatic devices for performing such addition at the proper time in the laundering cycle. Therefore, it has been tried to achieve softening effects by other means which would not involve a special trip and would not require repetition of a portion of the laundering cycle should the consumer or housewife unintentionally allow the rinse to be completed before she had added fabric softener. Thus, devices have been utilized to add fabric softening compounds to the laundry during a drying operation and detergent compositions have been made which contain so much softening or antistatic compounds that some of these are sorbed by the laundry during the washing operation and remain on it to soften the finished laundry. Such detergent compositions, while functioning as softeners too, are often disadvantages because the softening compound interferes with the action of the detergent and the detergent acts to prevent sorption of some of the softening material. Thus, for good cleaning and softening power, greater quantities of detergent and active softening ingredients are required than would be the case were such materials applied separately.

The compositions of the present invention include mixtures of organic compounds which, in conjunction with the described heavy duty synthetic detergent compositions based on alkali metal higher alkyl benzene sulfonate, alkali metal silicate and builder salt for the anionic synthetic organic detergent, such as alkali metal tripolyphosphate, nitrilotriacetate, citrate, carbonate or bicarbonate, act to improve detergency, while at the same time helping to soften textiles and laundry washed with such detergents. In accordance with the present invention a heavy duty particulate laundry detergent, which softens textiles washed with it, comprises 0.1 to 4% of $R^1O(CH_2CH_2O)_mPO(OM)_2$ wherein $R^1$ is a higher alkyl of 14 to 20 carbon atoms, m is from 1 to 6 and M is an alkali metal or ammonium; 0.1 to 3% of $[R^1O(CH_2CH_2O)_m]_2POOM$; 0.1 to 2% of $R^2OPO(OM)_2$ wherein $R^2$ is alkyl of 6 to 10 carbon atoms; and 0.1 to 1% of $(R^2O)_2POOM$; from 10 to 35% of an alkali metal higher alkyl benzene sulfonate; 2 to 50% of an alkali metal silicate; 10 to 60% of a non-silicate builder salt; 5 to 50% of an alkali metal sulfate and 1 to 15% of moisture. In preferred compositions the mixture of the mentioned organic phosphoric acid ester salts is 1 to 10% of the composition, the proportions of the individual components being those resulting from phosphating a mixture of 60 to 95% of $R^1O(CH_2CH_2O)_mOH$ and of 40 to 5% of $R^2OH$, producing from 40 to 70% of monoesters and 60 to 30% of diesters of phosphoric acid, and neutralizing such esters to the alkali metal ammonium salts thereof. Also within the invention is a method of washing and softening textiles by utilizing the invented compositions, usually at concentrations in the wash water of from 0.1 to 1.5%, often from 0.3 to 0.8%.

The organic phosphoric acid esters of the present invention includes $R^1O(CH_2CH_2O)_mPOOM$ wherein $R^1$ is a higher alkyl, usually of 14 to 20 carbon atoms, preferably of 16 to 18 carbon atoms and most preferably a mixture of higher alkyls of 16 to 18 carbon atoms, of which a major proportion, e.g., about ⅔, is of about 16 carbon atoms, m is from 1 to 6, preferably 1 or 2 to 4, most preferably about 2 and M is alkali metal or ammonium, preferably an alkali metal and most preferably, sodium. For best results the proportion of such salts is from 0.1 to 4% of the detergent composition, preferably from 0.5 to 3% and most preferably about 2%.

With the ethoxylated higher fatty alcohol monophosphoric ester di-salt will be present a diester mono-salt, preferably of a corresponding ethoxylated higher fatty alcohol. Such a compound is of the formula $[R^1O(CH_2CH_2O)_m]_2POOM$ wherein $R^1$, m and M are of the descriptions previously given. As with the other esters, they may be the same or different in different phosphoric acid ester salts and of course, throughout this description of the various components of the invention it is understood that mixtures of compounds within the broad descriptions may be employed. The useful proportions of the diester salts are within the range of 0.1 to 3%, preferably from 0.5 to 2% and most preferably are about 1.5%.

With the salts of mono- and diesters of higher fatty alcohol polyethoxyethanols there are present, functioning to improve the solubilities and stabilities of the compositions, lower molecular weight mono- and diphosphoric ester salts. The monoester di-salt compounds are of the formula $R^2OPO(OM)_2$ wherein $R^2$ is alkyl of 6 to 10 carbon atoms, preferably of about 8 carbon atoms and most preferably 2-ethylhexyl. The proportion of such compound in the detergent composition is from 0.1 to 2%, preferably from 0.5 to 1.5% and most preferably about 0.9%. The lower alkyl diester mono-salt is $(R^2O)_2$ POOM, also with the same preferred alkyls and salt forming ions as the corresponding organo-phosphorus compounds described herein. The proportion of such compounds will usually be from 0.1 to 1%, preferably from 0.3 to 1% and most preferably about 0.6%. The preferred salt forming ions are alkali metals, most preferably sodium.

The ratios of monoesters to diesters, with respect to both the polyethoxy higher alkanols and the lower alkanols which are phosphated will usually be from 4:1 to 2:3, preferably from 2:1 to 1:1. The proportion of the total of ethoxylated organophosphorus esters to those which are not ethoxylated is from 19:1 or 9:1 to 1:1, preferably from 4:1 to 3:2. Such mixtures of these four different types of phosphoric acid esters, normally comprising from 3 to 10% and preferably from 4 to 7% of the detergent composition, may be made by phosphating a mixture of 60 to 95% of $R^1O(CH_2CH_2O)_mOH$ and 40 to 5% of $R^2OH$ to produce from 40 to 70% of monoesters and 60 to 30% of diesters of phosphoric acid, which are then preferably neutralized to the alkali metal salts, e.g., sodium, or ammonium salts thereof.

In the present heavy duty detergent compositions the combination of members of the above four groups of organophosphorus compounds in mixture produces excellent detergency, solubility and softening properties in the product. While it is thought that the diester promotes softening and the monoesters improve solubilizing properties, with both contributing to detergency, it is not intended that the invention be so limited. Suffice it to say that unexpectedly, such a combination of organophosphorus compounds has yielded beneficial detergent and softening effects in heavy duty laundry detergent compositions so that addition of softener to the rinse water or utilization of softening means in the dryer may not be needed. Also, the softening and detersive effects obtained from the phosphorus compounds are not self-defeating since the reasonable proportions and small quantities of these materials described as useful in the present compositions give both detergent and softening effects.

Although various mixtures may be utilized it is generally preferably that when salts are employed they should all be alkali metal salts, especially all sodium salts. Instead of employing salts, the free acids may be used, with neutralization being effected in the process of manufacturing the detergent composition, as by sodium carbonate, sodium hydroxide, ammonia, sodium bicarbonate or other suitable alkaline material.

The acid form of such mixtures has been marketed by Berol Aktiebolaget (Sweden) under the name Berol TVM-729. Methods for the manufacture of such phosphate esters and mixtures thereof are described in British Pat. No. 1,012,418. Neutralization may be effected with alkali metal hydroxides, such as sodium hydroxide, or with other known neutralizing basic compounds, such as carbonates or phosphates, with the stoichiometric amount being employed to produce the desired complete neutralization of the phosphoric esters. In some cases, where there might be a small percentage of unreacted phosphoric acid present, e.g., 3% of the ester content, this too will be neutralized with the base employed, in which case a useful builder may be produced from it.

The anionic detergent of the present compositions which most satisfactorily combines with the organophosphorus compounds, the builders and other salts is most preferably a salt of higher alkyl benzene sulfonic acid in which the sulfonic acid group is neutralized with a base, most preferably an alkali metal, e.g., sodium. The higher alkyl may be of 10 to 18 carbon atoms but it is preferably of 11 to 15 carbon atoms and is most preferably of about 12 carbon atoms. Although some branching of the alkyl chain is allowable it is preferred to employ linear alkyls and normally these are terminally or 2-carbon joined to the benzene ring. In some cases substituted benzenes may function as the base for the alkyl aryl sulfonate but normally the ring is unsubstituted except for the alkyl and sulfonate groups. To produce a desirably foaming detergent of good washing power, in conjunction with the phosphoric acid esters and the builder salts in the present compositions one will employ from 10 to 35% of an alkali metal higher alkyl benzene sulfonate, preferably from 15 to 30% thereof and more preferably about 23%, especially when the alkali metal is sodium and higher alklyl is linear alkyl of 12 carbon atoms. Outside the 10 to 35% range of the mentioned anionic detergent, as at percentages as low as 5% and up to 50%, useful products are obtainable but below 10% the detergency and foaming fall off to such an extent that the products are not widely acceptable commercially as foaming detergents, although they may be useful for particular purposes, as when such good detergency is not needed and foaming is undesirable. At concentrations above 35% the product may be too tacky or too poorly flowing and often the advantages of increased detergency do not warrant the additional expense. Furthermore, some softening power may be lost at such high concentrations of the synthetic anionic organic detergent.

The higher alkyl benzene sulfonate detergents have been found to be of excellent compatibility with the described phosphoric acid esters and it is generally preferred that a linear alkyl benzene sulfonate (LAS) should be the only such anionic detergent employed with the phosphoric acid esters. However, if desired, other such anionic detergents may be utilized, in partial replacement of the alkyl benzene sulfonate. Thus, up to 50% of the alkyl benzene sulfonate may be replaced with higher fatty alcohol sulfates, paraffin sulfonates, olefin sulfonates, sulfated higher fatty alcohol polyethoxyethanols, sulfated alkylphenoxy polyethoxyethanols, monoglyceride sulfates, salts of higher fatty acid amides of N-methyl taurine, salts of higher fatty acid esters of isethionic acid, etc. The salt forming ions are generally of alkali metal or ammonium, e.g., sodium, the higher fatty groups, olefins and paraffins are of 12 to 20 carbon atoms and the other alkyls mentioned are of 6 to 9 carbon atoms. Mixtures of such detergent materials may also be used.

With the mixture of organophosphorus compounds and anionic synthetic organic detergent(s) described, very useful builder salts, which also may function to make the composition anti-corrosive to washing machine parts, especially those of aluminum, are the alkali metal silicates. Although silicates of greater alkalinity than those of an $Na_2O:SiO_2$ ratio of 1:2 have been employed in detergent compositions for their building and alkaline effects, in the present compositions the silicate should have no more alkali present than is in the 1:2 $Na_2O:SiO_2$ materials. A preferred range of such ratios is from 1:2 to 1:3.2 and more preferably this will be from 1:2 to 1:2.8, with the most preferable silicates being those having such ratios of 1:2.4 and 1:2.35. If a potassium silicate is employed instead of the sodium silicate or instead of part of it, the $M_2O:SiO_2$ ratio will be similar and preferably is the same. The proportion of alkali metal silicate in the product will normally be 2 to 50%, with greater amounts in this range being employed when the silicate is a primary builder salt and lesser amounts being used when it is present mainly for pH adjusting and anti-corrosion purposes. Preferred ratios of silicate for such latter uses will be 4 to 10%, preferably about 6%, whereas when the silicate is utilized as a builder the proportion present will generally be over 10% and often over 20%, with an upper limit of about

50%.

In the present compositions, to make them satisfactory heavy duty detergents, while still allowing the softening effects of the organo-phosphorus compounds to be appreciated, another builder salt than the silicate will also be present. Such a non-silicate builder salt will also usually be an alkali metal salt such as a tripolyphosphate, carbonate, bicarbonate, nitrilotriacetate, 2-hydroxyethyl nitrilodiacetate, citrate, gluconate, or other suitable material for this purpose. The polybasic acids from which the salts are made are preferably completely neutralized but partially neutralized salts are also useful. The salt forming ion will normally be alkali metal and most preferably is sodium but other ions, e.g., ammonium, are sometimes employed. Mixed neutralizing ions are useful and of course, mixtures of the builder salts may be used. EDTA, either as the completely neutralized alkali metal salt, tetrasodium ethylenediamine tetraacetate or as a partially neutralized or mixed salt, may also be employed but is generally not as satisfactory as the other materials mentioned. It has been found that despite the alkaline and/or sequestering effects of the builders the mixed phosphate esters exert both detergent and softening properties and also help to improve the ability of washed laundry and textiles to resist accumulations of static charges. To obtain such desirable effects the proportion of the supplementing or non-silicate builder employed will be in the range of 10 to 60%, preferably 20 to 50% and most preferably about 30%, especially when the builder is pentasodium tripolyphosphate.

In addition to the so-called active materials of these compositions other important constituents are filler salt(s) and moisture. A filler salt helps to improve the mechanical properties of the product, usually improving the flow rate and countering any tendency toward tackiness. It may also aid in promoting ready solution of the product in wash water. Among useful filler salts the best is sodium sulfate, preferably in the anhydrous state. However, other fillers, including sodium chloride, sodium acetate, and the alkali metal salts of such acids, may also be used, as may be starches, talcs, silicas and various other fillers which perform a carrying or supporting function. The proportion of filler or mixture thereof will be within the 5 to 50% range, preferably being 10 to 30% and most preferably about 20%, especially when sodium sulfate, anhydrous, is the filler salt. The percentages of moisture will normally be from 1 to 15%, preferably 5 to 12% and most preferably about 8%, especially in compositions based on the mentioned proportions of the phosphoric acid esters, sodium silicate, sodium tripolyphosphate and sodium sulfate. When such proportions are used a satisfactorily flowing particulate, pulverulent or granular product results, which, by control of particulate size and moisture content, can be prevented from being excessively dusty.

Various adjuvants may be present in the detergent compositions, each of which contributes its desired supplementary effect. Among these are included fluorescent dyes, whitening agents, bleaches, germicides, fungicides, enzymes, soil suspending agents, additional fabric softeners, if desired, flow promoting agents, additional corrosion inhibitors, tarnish inhibitors, perfumes, colorants, stabilizers, antioxidants, buffering agents and other pH regulators, and various other materials intended to improve the functional and/or aesthetic properties of the detergents. Such materials are well known in the art and need not be described at length here. However, it will be mentioned that among the enzymes which may be added to the detergent those which are preferred are of the proteolytic type, including subtilisin, bromelin, papain, trypsin and pepsin. Soil suspending materials or anti-redeposition agents, such as sodium carboxymethyl cellulose, methyl cellulose, polyvinyl aocohol and hydroxypropyl ethyl cellulose will also often be present. The proportions of adjuvants utilized will usually be less than 20%, frequently less than 10% and normally will not exceed 8% of the composition. Each of the adjuvant ingredients will usually be present to the extent of 2% or less except sodium perborate bleach, which may be up to 30%.

The detergent compositions may be in hollow bead form such as is obtained from spray drying but often, if spray dried, the detergents will have a flow promoting agent in finely divided powdered form with them. Talcs, silicas and calcium aluminum silicates are useful for this purpose. Such adjuvants will normally have a particle size of less than 150 mesh (100 microns diameter) frequently less than 200 mesh (74 microns) and often from 200 to less than 325 mesh (44 microns). The particle sizes of the beads of spray dried detergent compositions are normally in the 6 (3.3 mm.) to 150 mesh, U.S. Sieve Series, range, preferably of 8 to 100 (2.3 mm. to 149 microns). If not spray dried, the various constituents of the compositions may be blended together as dry ingredients which may initially be of the desired particle sizes or may be subsequently ground or otherwise size-reduced to the desired size range. Such powdered or particulate materials are usually of a particle size within the range of 6 to 200 mesh and most of the time will be in the 20 to 180 mesh range (840 to 85 microns). Such powders are not unduly dusty and, especially if a flow improving agent is employed, are satisfactorily free flowing, even with higher percentages of the phosphoric acid esters and anionic detergent present (such materials being the most likely of the required ingredients to be tacky).

Methods of spray drying the present compositions by dry blending and size-reducing them or other techniques for producing the final particulate detergents do not constitute important parts of the present invention, with the exception of those methods which include a procedure for manufacturing the desired mixture of phosphoric acid esters, and consequently, are not described at length herein. Also, spray drying, dry blending and size-reducing are techniques well known in the detergent art. Suffice it to say that it is generally preferred to pre-mix the organic phosphoric acid esters and the synthetic organic anionic detergent, as beads or powders, and then to admix the various inorganic salts. The powders may be agglomerated to particle sizes like those of the spray dried detergent compositions, may be pressed into briquette or tablet form or may be converted to chips, flakes or "noodles" by methods known in the detergent art.

Whatever the form of the laundry detergent its use in the washing process is essentially the same. The particulate composition is usually added to wash water in an automatic washing machine so that the concentration thereof in the wash water is about 0.05 to 1.5%, usually 0.1 to 0.9% and preferably about 0.5%. The water to which it is added will preferably be of medium or low hardness, e.g., from 30 to 120 parts per million of hardness, as calcium carbonate, but both softer and harder waters may be usefully employed. The water temperature can be from 10°C. to 100°C. and is preferably from 60° to 100°C. in those cases where the textile or laundry is capable of withstanding high temperatures without deterioration or fading of dyes. When low temperature laundering is desired, the temperature may be held at 10° to 40°C., under which conditions good cleaning and softening are the result, although the product may not be as clean as when washed at the higher temperatures. At the concentrations of detergent compositions mentioned the pH of the wash water will usually be from 9 to 11, preferably from 9 to 10. At such ph's the composition is effective as a detergent, not unduly harsh to the material being washed nor to human skin and effectively cleans and softens. The laundry:wash water weight ratio wil usually be about 1:5 to 1:30 or 1:10 to 1:30.

In the wash water the concentrations of phosphoric acid esters will be from 0.0001 to 0.06% of $R^1O(CH_2CH_2O)_mPO(OM)_2$, 0.0001 to 0.045% of $[R^1O(CH_2CH_2O)_m]_2POOM$, 0.0001 to 0.030% of $R^2OPO(OM)_2$ and 0.0001 to 0.015% of $(R^2O)_2POOM$, preferably 0.002 to 0.030% of $R^1O(CH_2CH_2O)_mPO(ONa)_2$, 0.0015 to 0.025% of $[R^1O(CH_2CH_2O)_m]_2POONa$, 0.001 to 0.015% of $R^2OPO(ONa)_2$ and 0.0005 to 0.009% of $(R^2O)_2POONa$. The proportions of the other constituents of the compositions are from 0.01 to 0.5% of the higher alkyl benzene sulfonate, preferably 0.02 to 0.27% thereof; 0.002 to 0.75% of the alkali metal silicate, preferably 0.005 to 0.25% thereof; 0.01 to 0.9% of the non-silicate builder salt, preferably from 0.03% to 0.45% of sodium tripolyphosphate; and 0.005 to 0.75% of sodium sulfate, preferably 0.02 to 0.25%. At such concentrations and under the described washing conditions excellent cleaning is obtained of cottons and synthetic fabrics, including "permanent-pressed" materials, and the surfaces thereof are desirably soft and pleasant to the hand. The washing operations may take from 5 minutes to one hour, depending on the type of material being laundered and the agitation may be in an automatic home laundry washing machine of the top opening tub or horizontally rotating cylinder type. However, the top loaders are often preferred with the present foaming detergents. Instead of utilizing a washing machine, the detergent compositions may be employed for hand washing clothing or in boiling tubs, which may be hand stirred. However, of these methods it is most preferred to employ the automatic washing machines of the top loading, vertically oriented tub type. After completion of the washing, which may be multicycle with intermediate rinses, the textiles are finally rinsed with clear water and are dried, either in an automatic laundry dryer, by sunlight drying or by other suitable means.

The advantages of the invention have been referred to previously but will be briefly recounted here. The combination of organic phosphoric esters possesses the desired hydrophilic and lipophilic properties to be a successful detergent, as well as a good softening agent. The extent of ethoxylation mentioned contributes hydrophilic properties which balance the lipophilic character of the higher fatty alcohols. The comparatively short chain unethoxylated phosphoric acid esters already possess such a balanced hydrophilic-lipophilic nature. Although they are not as effective in washing ability as the ethoxylated higher fatty alcohol phosphoric acid compounds they improve the wetting power of the product and its physical characteristics, aiding in making it freer flowing. They also help to solubilize detergent composition components. It appears that the ethoxylated diesters of phosphoric acids are the most important of the softening compounds whereas the monoesters are better detergents. As will be noted, both such types of compounds are solubilized by the corresponding shorter chain alcohol phosphoric acid esters. The various mentioned phosphoric acid esters, in combination, are low foaming but in the presence of the rather substantial proportions of alkyl benzene sulfonate present, do not adversely affect foaming characteristics even when they are employed to replace the some detergent.

When the formulations of the present invention are tested against control compositions, in which the mixture of organic phosphoric acid esters is replaced by a corresponding weight of sodium alkyl benzene sulfonate, despite the drop in content of the anionic detergent of choice, usually LAS, compared to the control, there is no discernible difference in detergency. In the most significant washing operations, in which cotton cloths (calico and terrycloth) are employed wherein differences would be expected to be discernible, members of test panels find no such distinction. In fact, possibly due to their preference for textiles washed with the present compositions, a preference for detergency is sometimes also found for materials washed with the invented products. Such finding of equivalence of the experimental and commercial products is also noted after a plurality of washes in which detergency, anti-redeposition action and bleaching (when bleach is present in the composition) are evaluated. With respect to softening effects, checked after every third wash through a total of twelve washes, there is a significant preference for the "experimental" laundry, especially when the materials compared are cotton towels, often considered to be the ultimate tests for softening actions of detergents. In addition to softening effects, it is noted, especially with synthetic materials, that antistatic action is apparent in the laundry treated with the experimental detergent compositions of the present invention.

The detergency results obtained using the softening agents in the washing compositions are far superior to those resulting when corresponding quantities of other softeners, such as the quaternary ammonium halides, e.g., dimethyl distearyl ammonium chloride, are employed. In the latter case, detergency is diminished noticeably and often clothes are yellowed, effects not noted with the present compositions. Also, the present organic phosphoric acid ester mixture is compatible with various detergent and builder materials. For example, a variety of the normally preferred anionic synthetic organic detergents may be employed and builder salts may be changed. Thus, if it is desired to avoid inorganic phosphates in the product, formulations based on silicates, carbonates, bicarbonates, sulfates, chlorides, citrates, gluconates or NTA may be utilized and softening will still be obtainable. Of course, mixtures of such builders may be utilized, as is the case with various other components of this composition.

A final advantage of the invention is in the trouble-free nature of its application. It is not necessary to add the fabric softener or antistatic agent in the rinse water and it is not even necessary for anything to be added in the laundry dryer, although supplemental softening operations may be employed, if desired. The softening agent, possessing detergent properties, is a part of the detergent composition and is added with it in the beginning of the wash, after which the entire operation may be automatic and requires no special equipment for dispensing softener during laundering cycles. While no additional softening operation or step is required, the softening agent performs a useful detergent action, unlike other softeners which interfere with detergency. That such would be the case with heavy duty synthetic organic detergents of the present formula is unexpected and would not have been predictable from the prior art.

The previous description has been largely with respect to foaming heavy duty laundry detergents. These are described in parent French patent application No. 72/26683. Although foaming detergents are often desirable, especially for hand laundering and automatic laundering in which top-loading washers are employed, in some instances it may be desirable to diminish the foam or eliminate it entirely, especially when the detergent is to be used in horizontal drum automatic washing machines. One way to diminish such foaming of the present composition is to decrease the content of synthetic anionic organic detergent and to add soap to the formula. Thus, the synthetic anionic detergent content may be reduced to 1 to 8%, and preferably is an alkali metal higher alkyl aryl (e.g., benzene) sulfonate, and there may be included from 2 to 20% of alkali metal higher fatty acid soap, which also has useful detergent properties in these compositions. The silicate and non-silicate builder salt contents may remain at 2 to 50% and 10 to 60%, respectively and the content of alkali metal, filler salt, e.g., alkali metal sulfate, may be broadened somewhat, to the 3 to 50% range, whereas that of water is usually from 2 to 15%. The proportions and types of organic phosphates esters described will be the same. The detergent compositions resulting will be utililzed in the same manner and in the same proportions in wash waters.

To produce the desirably low foaming detergent compositions the proportion of alkali metal higher alkyl benzene sulfonate utilized is 1 to 8%, preferably 2 to 5% and more preferably, about 2.5 to 3%. Outside the 1 to 8% range of the mentioned anionic detergent, when less than 1% is used detergency is noticeably poorer and when more than 8% is employed the extent of foaming is often too great and may be objectionable.

Contributing significantly to the detergency, softening power and low-foaming or non-foaming characteristics of the present detergent compositions is the higher fatty acid soap constituent. Although ammonium and triethanolamine soaps and various other soluble soaps may be utilized, it is highly preferred to employ the alkali metal soaps, most preferably the sodium soaps of higher fatty acids of 10 to 20 carbon atoms. Such soaps are mainly of fatty acids of 12 to 18 carbon atoms and preferably are of 16 to 18 carbon atoms. Although various animal and vegetable oils may be employed as sources of the lipophilic portions of the soaps, such as tallow, animal greases, coconut oil, corn oil, palm oil, palm kernel oil, cottonseed oil, and safflower oil, generally mixtures of beef tallow and coconut oil have been utilized. For best results, it is preferred to use tallow alone so that the soap will normally be of 16 to 18 carbon atoms, comprising mainly sodium palmitate, sodium oleate and sodium stearate. In some cases it may be desirable to derive the fatty acids from the tallow and to hydrogenate such acids or to hydrogenate the tallow used to make the soap, so that the end product will be essentially saturated. The higher fatty acid soaps, especially the tallow soaps, have an especially strongly depressing effect on foam, while at the same time contributing effectively to the cleaning power and softening effects of the present compositions. They are especially useful in improving cleaning in high temperature washing operations. To obtain the good results mentioned the proportion of alkali metal higher fatty acid soap present will usually be from 2 to 12% and is preferably 3 to 10%. Most preferably, in the presently described compositions, from 4 to 8% thereof is utilized.

The silicate salts are used in proportions like those described for the foaming detergents but preferred contents when they are used as builders are over 12% and often over 20%, with an upper limit of about 50%, and when they are used as anti-corrosion agents, 4 to 12%, preferably about 6%. The supplementing non-silicate builder salts utilized will generally be present in proportions from 10 to 60%, preferably 25 to 60% and most preferably about 35 to 50% in these formulations, especially when the builder is pentasodium tripolyphosphate.

The proportion of filler (usually sodium sulfate) or mixture of fillers or filler salts, is within the 3 to 50% range, preferably being 3 to 25% and most preferably about 5 to 10%, expecially when sodium sulfate, anhydrous, is the filler salt. The percentage of moisture will be from 2 to 15%, preferably 2 to 12% and most preferably is about 5 to 10%.

The low sudsing or non-sudsing detergent compositions are employed in essentially the same manner as the higher foaming products previously described and at similar concentrations. However, the preferred concentration range for the detergent in the wash water is 0.3 to 0.8% rather than 0.1 to 0.9%. The proportions of the various phosphate ester constituents in the wash water are in the same ranges as previously given for use of the more highly foaming compositions but the proportion of higher alkyl benzene sulfonate is 0.001 to 0.12%, preferably 0.003 to 0.06% of sodium higher alkyl benzene sulfonate, with an alkyl of 11 to 15 carbon atoms; that of alkali metal higher fatty acid soap is 0.002 to 0.18%, preferably 0.006 to 0.06% of sodium higher fatty acid soap wherein the higher fatty acids are of 16 to 18 carbon atoms; the alkali metal silicate is from 0.001 to 0.75%, preferably 0.007 to 0.25% of sodium silicate of $Na_2O:SiO_2$ ratio from 1:2 to 1:3.2; the non-silicate builder salt is from 0.005 to 0.90%, preferably from 0.04 to 0.45% of sodium tripolyphosphate; and the alkali metal sulfate is from 0.003 to 0.75%, preferably 0.006 to 0.25% of sodium sulfate.

When the soap-containing formulations described are tested against control compositions in which the mixtures of organic phosphoric acid esters are replaced by corresponding weights of ethoxylated alcohols or ethoxylated alkyl phenols, which are sometimes employed in low foaming or non-foaming detergent compositions, detergency and anti-redeposition actions are about the same even after as many as twelve washes but the preferences of experienced evaluators for softness and their overall preferences in the terrycloth towel washing tests (the most difficult tests) are significantly in favor of the compositions containing the organophosphorus esters. And, of course, in the tests described, which are run in automatic laundry machines of the horizontal drum type, better detergencies result from use of the present soap-containing and low foaming detergents, compared to softening detergents which do not contain the soaps, and which therefore foam. It is also noted that when the compositions containing soaps are employed for washing by hand at relatively high concentration in medium or high hardness waters the percentages of soaps in the products can be decreased within the ranges given, while good general cleaning effects are obtained and the amount of scum on the surface of the laundry water is diminished when the organophosphorus compound-containing compositions are also helpful in diminishing a normal tendency toward accumulations of static charges by materials laundered, such as nylons, polyesters, acetates and rayons.

Instead of adding soap to the present detergent compositions to diminish the foaming thereof it has been found that products which, surprisingly, are low foaming or non-foaming when employed in automatic washing machines of the horizontal drum type and yet, are satisfactorily foaming for "hand washing" applications, can be made by including with the mixtures of phosphoric acid esters of polyethoxylated alcohols (and accompanying alkanols) together with the anionic synthetic organic detergent, alkali metal silicate (and supplemental builder), a nonionic synthetic organic detergent or surface active agent. The nonionic employed is an ethoxylated alcohol or an ethoxylated alkyl phenol, the former being of the formula $RO(CH_2CH_2O)_nH$, wherein R is of 9 to 20 carbon atoms and $n$ is from 5 to 100, and with the latter being of the formula

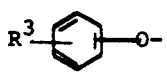

$(CH_2CH_2O)_sH$ wherein $R^3$ is alkyl of 7 to 12 carbon atoms and $s$ is from 8 to 25. Of course, mixtures thereof may also be employed. A decided advantage of the essentially non-foaming or low foaming (in automatic horizontal drum washing machines) detergents described is in their avoidance of curd production which can result when soap is employed, as in parent French patent application No. 72/26684. The number of the French parent application relating to the use of the described nonionics in the present softener compositions is 72/26685.

The phosphoric acid mono- and diesters utilized in the making of the controlled foaming detergent compositions described herein are of the same types and of the same proportions of constituents as previously set forth, with the following exceptions. They constitute from 3 to 10% of product, in total. $R^1O(CH_2CH_2O)_m$-$PO(OM)_2$ is from 0.1 to 4% of the detergent, preferably 0.1 to 3% and most preferably about 1.6% and $m$ thereof is from 1 to 6, preferably 1 to 4. $[R^1O(CH_2CH_2O)_m]_2POOM$ is from 0.1 to 3%, preferably 0.1 to 2% and most preferably about 1.2%, with $m$ being as previously designated for $R^1O(CH_2CH_2O)_mPO(OM)_2$. A middle alkanol phosphate ester accompanying the ethoxylated phosphate esters, of the formula $R^2OPO(OM)_2$, is present in the same proportions as previously described for the foaming composition but a most preferably proportion is about 0.7%. Similarly, $(R^2O)_2POOM$ will most preferably be present at a concentration of about 0.5%.

The anionic detergent of the nonionic-containing controlled foam compositions of this invention will usually be of a higher alkyl of 9 to 15 carbon atoms, preferably of 10 to 13 carbon atoms and most preferably of about 12 carbon atoms. Normally, 4 to 12% thereof will be employed, preferably 6 to 10% and most preferably about 8% and the preferred alkyl will be a linear alkyl. Outside the described 4 to 12% range foaming is too great at higher concentrations and it is lower than desirable for hand washing, at the lower concentrations.

Preferred nonionics of the aliphatic type are those wherein $n$ is from 10 or 30 to 70 and R is a mixture of linear alkyls of 16 to 18 carbon atoms, with most preferred compounds of this type having R of 16 and 18 carbon atoms and $n$ of 50 or thereabout. When the aromatic nonionics are utilized $R^3$ is preferably of about 9 carbon atoms and $s$ is preferably about 10 to 20, most preferably about 15. Instead of the alkyl phenols, corresponding dialkyl phenols may be polyethoxylated and utilized. Also, other nonionic detergents may be substituted but normally such substitution will be limited to 50% of the entire nonionic detergent content. However, it is much preferred to employ the named nonionic, either separately or in mixture. The nonionic detergent or mixture will usually be from 2 to 10%, preferably 2 to 5% and most preferably, about 3% of the detergent compositions, especially when the nonionic is aliphatic, as previously described. The percentages of the above named constituents are most satisfactory for obtaining good detergency, softening and controlled foam properties. Generally, to accomplish these the total of the anionic and nonionic detergents and organic phosphoric acid esters of the types named will be 8 to 20%, preferably 12 to 18% and the ratio of anionic detergent, e.g., higher alkyl benzene sulfonate, to the sum of the nonionic detergent, e.g., $RO(CH_2CH_2O)_nH$, and the organic phosphoric acid esters is from 1:2 to 2:1, preferably from 1:1.5 to 1.5:1. Within such ratios the nonionic and phosphoric acid esters balance the foaming tendencies of the anionic detergent.

The silicates utilized are those of an $Na_2O:SiO_2$ ratio of less than 1:1.5. An acceptable range of such ratios is from 1:1.5 to 1:3.2, preferably from 1:1.8 to 1:2.8, with the most preferable silicates being those having ratios of 1:2 to 1:2.4. If a potassium silicate is employed instead of the preferred sodium silicate or instead of part of it, the $M_2O:SiO_2$ ratio is similar and preferably the same. The proportion of alkali metal silicate in the products will normally be 3 to 60%. Preferred ratios of silicate, when it is an anti-corrosion agent, are in the range of 3 to 10%, most preferably being about 5% and when it is a builder the proportion present will generally be over 10%, often over 20%, with the upper limit being about 60%. Non-silicate builder salts of the types previously described may be utilized, and normally will be present in a percentage of 2 to 50, preferably 10 to 50 and most preferably about 40, especially when the builder is pentasodium tripolyphosphate. Fillers, preferably filler salts such as sodium sulfate, but also including the other fillers previously described, will be from 2 to 50% of the composition, preferably from 3 to 30% thereof. The moisture content will be from 1 to 15%, preferably 2 to 10%. Other adjuvants, of the types previously described, will be present in the proportions previously given. Some special additives include anti-redeposition agents the most preferred of which are sodium carboxymethyl cellulose, polyvinyl alcohol and polyvinyl pyrrolidone. These are normally present to the extent of from 0.2 to 5%, preferably 0.3 to 1%. The sequestrants, which include NTA and EDTA, may be present in minor proportions, e.g., 0.1 to 2%, preferably 0.1 to 0.5%, if not employed as builders. As sequestrants, their function is essentially different from a building activity and relates to preventing depositing of sequesterable materials on the laundry, rather than building detergency. Flow improving agents are normally natural or synthetic clays, talcs or silicas but may include hydratable salts. Generally they are added to a granular product to take up moisture or other liquid or tacky material and to promote flow and prevent caking of powders on storage. Exemplary of these materials are calcium aluminum silicates and clays such as those sold under the name Satintone. Proportions employed are normally from 0.1 to 5%, preferably from 0.2 to 2%.

The sizes of the particles of the product and various components thereof and the methods of manufacture are essentially the same as those described for the foaming, softening detergent compositions, previously disclosed. However, it may be mentioned that when components of the present products do not readily lend themselves to spray drying these may be blended with or sprayed onto particles composed of the rest of the detergent composition or parts thereof. The organic phosphoric acid esters may cause spray dried particles to be tacky and nonionic detergents, when spray dried, are often decomposed or fumed to a substantial extent, with the remaining nonionic tending to migrate to the particle surfaces and cause poor flow thereof. Of course, perborates and perfumes, being unstable at the elevated spray drying temperatures, will normally be post-added, as will be flow improving agents.

The methods for using the present control foaming compositions are essentially the same as those employed for the foaming detergent, previously described, with concentrations in automatic washing machines being from 0.05 to 1.5%. Similar or higher concentrations may be employed for hand washing of laundry. The water utilized should be of a hardness of less than 300 p.p.m., as calcium carbonate. Compared to detergent compositions containing soap for its foam-depressing effects, together with the phosphoric esters, the improved foam control and curd free properties of the present composition are most noticeable in automatic washing in soft water wherein, at less than 100 p.p.m. the "control" compositions can foam objectionably whereas the present products do not. In hand washing the greatest improvements are noticed at higher hardnesses, since the present materials do not produce the objectionable curd sometimes noted in detergents containing soaps. The water temperature can be from 10°C. to 100°C. for hand washing but the lower limit is normally about 25°C. For machine washing in a horizontal drum automatic washer the upper limit on the temperature is preferably held to 90°C., to avoid excessive generation of foam caused by vaporization of the water. If the machine is held under pressure higher temperatures can be employed so long as this generation of excessive foam is avoided. When using such higher temperatures the textiles or laundry washed will be selected so as to be capable of withstanding them without deterioration or fading of dyes. When low temperature laundering is desired, the temperature may be held at 10° to 40°C., under which conditions good cleaning and softening are the result, although the product may not be as clean as when washed at the higher temperatures. With the present detergent compositions the proportion of laundry or textiles being washed to wash water will usually be in the range of 1:5 to 1:30, although it is clear that for removing stubborn stains higher concentrations may sometimes be desirable and occasionally, pastes may be made of the detergent composition and applied to especially dirty or stained spots to improve removals thereof.

In the wash water the concentrations of various detergent components will be 0.001 to 0.06% of $R^1O(CH_2CH_2O)_mPO(ONa)_2$ wherein $R^1$ is a higher alkyl of 16 to 18 carbon atoms and $m$ is from 1 to 4, 0.001 to 0.045% of $[R^1O(CH_2CH_2O)_m]_2POONa$, 0.001 to 0.03% of $R^2OPO(ONa)_2$, 0.001 to 0.015% of $(R^2O)_2$-POONa, 0.004 to 0.18% of sodium higher alkyl benzene sulfonate wherein the higher alkyl is of 10 to 14 carbon atoms, 0.002 to 0.15% of $RO(CH_2CH_2O)_nH$ wherein R is of 16 to 18 carbon atoms and $n$ is from 10 to 70, 0.003 to 0.90% of sodium silicate of $Na_2O:SiO_2$ ratio of 1:1.8 to 1:2.8 and 0.01 to 0.75% of sodium tripolyphosphate. Instead of the sodium tripolyphosphate, equivalent amounts of other builders, including sodium silicate, may be employed. Using such concentrations in the automatic horizontal axis washing machine good laundering and softening are obtained without suds locking and in hand washing satisfactory foaming develops and cotton and other textiles are effectively washed and softened.

The washing operations may take from five minutes to an hour but normally only ten or twenty minutes will be required. Pre-soaking or pre-washing is preferred but usually it is not necessary. After completion of washing the laundry is rinsed with clear water and dried, either in an automatic laundry dryer, by sunlight drying or other suitable means.

The advantages of the invention are most noticeable when the present compositions are compared with other controlled foaming detergents. Frequently, such detergents will foam objectionably in horizontal axis washing machines if the laundry being washed is only lightly soiled and the wash water is of low hardness. The present compositions are superior in this respect. Also, when the control compositions include soap as a foam suppressant, soap curd may be noted in hard water hand washing of laundry whereas with the present composition, under the desired suds produced the wash water is clear. Such advantages are obtained accompanied by good detergency and softening and antistatic effects due to the presence of the organic phosphorus ester compounds mixture.

The following examples illustrate but do not limit the invention. Unless otherwise indicated, all parts are by weight and all temperature are in °C.

EXAMPLE 1

| | Parts |
|---|---|
| * $R^1O(CH_2CH_2O)_2PO(ONa)_2$ | 2.0 |
| * $[R^1O(CH_2CH_2O)_2]_2POONa$ | 1.5 |
| ** $R^2OPO(ONa)_2$ | 0.9 |
| ** $(R^2O)_2POONa$ | 0.6 |
| Sodium linear dodecyl benzene sulfonate | 23.0 |
| Sodium silicate ($Na_2O:SiO_2 = 2.4$) | 6.0 |
| Pentasodium tripolyphosphate | 30.0 |
| Sodium sulfate, anhydrous | 20.0 |
| Moisture | 8.0 |
| Adjuvants (perfume, dyes, proteolytic enzymes, fluorescent brighteners, sodium carboxymethyl cellulose, antioxidant) | 8.0 |

* $R^1$ = mixed higher alkyls of 16 to 18 carbon atoms (65% $C_{18}$ and 35% $C_{16}$)
** $R^2$ = 2-ethyl-n-hexyl The above materials are blended together in a ribbon mixer for about 5 minutes, all being of particle sizes in the 60 (250 mm.) to 200 mesh (0.74 microns) range, after which they are passed through a pulverizing machine and are screened so that the product taken off is uniform and of particle sizes in the 100 (149 micron) to 200 mesh range.

The foaming detergent composition is employed to wash cotton terrycloth towels with the concentration of detergent composition being 0.5% and the weight of toweling being about 10% that of the wash water. The wash water is of a hardness of about 150 parts per million, as calcium carbonate.

Initially, the toweling is subjected to a ten minute pre-wash in cold water, after which it is boiled at about 100°C. for 5 minutes. Alternatively, the toweling may be washed for 10 minutes at 85°C., as in a Normalux automatic washing machine. Also, variations in the experiments are made wherein the proportion of toweling or other textiles or laundry to wash water is from 1:5 to 1:30, with the detergent concentration being in the range of 0.05 to 1.5%.

In a similar manner, the composition comprising the same quantities of each of the constituents, with 5% additional sodium linear dodecyl benzene sulfonate in replacement of the organic phosphoric acid esters, is employed as a control. After the completion of ten washings of the terrycloth towels, alone or mixed with calico (cotton) and/or normally soiled clothing, the terrycloth towels are submitted to a panel of trained observers, experienced in the evaluation of laundry and detergents, who report their preferences without knowledge of the identities of the materials being examined. With respect to detergency, soil-redeposition, whiteness and stain removal, the terrycloth washed with experimental detergent is rated equal or superior to terrycloth washed with the commercial detergent containing 5% more of LAS. After every third wash the materials are examined for softness and satisfactory feel to the human hand. In such cases, fifty-eight evaluators indicate that the preferred detergent is the experimental detergent, with only fourteen evaluators favoring the control. The experimental wins over the control with respect to general preference, too, by a significant margin. Similar results are obtained for washings of calico (cotton) test cloths.

EXAMPLE 2

A variation of the composition of Example 1 is made in which $R^1$ of the softening phosphoric ester compounds is a mixture consisting primarily of $C_{16}$, $C_{18}$ and $C_{20}$ higher alkyls, with smaller quantities of $C_{14}$ and $C_{22}$ alkyls. The alkyl composition of such esters is 51% $C_{16}$, 30% $C_{18}$ and 14% $C_{20}$, with the remaining $R^1$ component being divided between $C_{14}$ and $C_{22}$. In this experiment, conducted in the same manner as that described in Example 1, and in variations of these experiments, when the concentrations of detergent composition in wash waters are diminished to 0.3% and 0.15%, results like those of Example 1 are obtained, although at the lower concentrations the significance of the preference for the experimental formula is not as great. In all such cases the detergent foams and cleans well and effectively.

EXAMPLE 3

The formula of Example 1 is modified by changing the proportions of sodium linear dodecyl benzene sulfonate from 23.0 to 2.5%; of pentasodium tripolyphosphate from 30.0 to 48.0%; of sodium sulfate, anhydrous, from 20.0 to 27.5%; of moisture from 8.0 to 5.0%; and of adjuvants from 8.0 to 1.5%; while including in the formula 4.5% of sodium tallow soap, from distilled tallow fatty acids. Blending of the detergent components together is carried out in the same manner as described in Example 1 and the washing of cotton terrycloth towels and calico cloths is conducted at the same concentrations. However, a tumbler type automatic washing machine identified as Miele "421" deluxe, is utilized at cycle No. 1 with a mixed terrycloth-calico load of 6.5 lbs. (3 kg.) in five gallons (19 liters) of water, with five ounces (140 grams) of detergent composition being employed in a pre-wash and subsequently also, in washing. The maximum foam height visible through the transparent washing machine door is about 10–12 centimeters when the laundry is lightly soiled and about 2–4 cm. when it is heavily soiled. Similar results are obtained when the water hardness is varied from 0 to 400 parts per million at 50 p.p.m. increments. The same experiments are repeated with an Alfol brand polyethoxylated higher fatty alcohol (higher alcohol of 16–18 carbon atoms and EtO:ROH molar ratio of 1:50) being used in the same quantity (5%) to replace the organophosphorus esters. The terrycloth and calico materials washed are compared and such comparisons are repeated every second wash until a total of twelve washes has been completed for each of the "experimental" and "control" compositions. Both compositions appear to foam about the same, with the "experimental" foaming somewhat less. Washing effects are the same in whiteness and redeposition of the soil. However, with respect to softness, of 54 evaluations of the terrycloth by judges accustomed to evaluate laundry softness, 41 evaluations favor the cloth washed by the experimental formulation. Similary, the calico is also judged to be softer when washed with the experimental formulation. Essentially the same results, indicating the superiority of the experimental formula, are obtained when the control composition is essentially the same but includes 15% of a quaternary ammonium softener such as dimethyl distearyl ammonium chloride, in place of some of the sodium sulfate. However, in such cases, detergency is noticeably poorer and the clothes become yellowed after repeated washings.

When the above experiments are repeated, utilizing 21.5% of sodium perborate in both the "experimental" and "first control" formulations, the same preferences are indicated and the control and experimental compositions wash and bleach equally well at the washing conditions employed, 85°C. for 15 minutes. Repetitions of the above experiments utilizing 3% total of the organophosphorus esters in the same proportions also result in satisfactory laundering, with the material being washed exhibiting softness, although less than in the 5% compositions. Also, when the concentrations of detergent compositions in the wash water are varied over the 0.1 to 1.5% range, softening is apparent, but, as would be expected, it is much more noticeable at the higher concentrations. At the various concentrations of the organophosphorus compounds in the compositions and of the compositions in the wash water, the experimental materials surpass the controls in softening activity.

When the sodium tripolyphosphate content of the detergent composition is replaced by 30 parts of nitrilotriacetic acid, trisodium salt or by a mixture of 10 parts of sodium carbonate and 35 parts of sodium silicate of an $Na_2O:SiO_2$ ratio of 1:2.35, good softening is obtained, also superior to that from control compositions. In cases where the high contents of sodium silicate or other materials which may contribute to poor flowing are present addition of flow promoting agents, such as a clay sold under the name Satintone, improves the flow properties and aids in preventing caking or storage.

With respect to the control formulation and other low foaming or non-foaming formulas containing nonionic detergents it has been found that the described combinations of organophosphorus compounds allow the replacement of some nonionic and additionally, permit the diminution of soap content and the corresponding increase of synthetic anionic detergent, while maintaining the foam about constant. Thus, where desired, the extra cleaning power of LAS or similar anionic detergent may be obtained without destroying the utility of the low foaming or non-foaming product. Of course, where desired, some of the nonionic detergent may be allowed to remain in the product to supplement the detergent effects of the other components.

EXAMPLE 4

The formula of Example 3, with the modifications to be described, is made and tested against the control compositions in the same manner as described in Example 1. The changes in the formula are in the use of 3% of sodium dodecyl benzene sulfonate instead of 2.5%; 7.0% of sodium tallow soap instead of 4.5% of sodium tallow soap from distilled tallow fatty acids; 8.0% of sodium silicate ($Na_2O:SiO_2$ = 1:2.35) instead of 6.0% of sodium silicate ($Na_2O:SiO_2$ = 1:2.4); 35% of pentasodium tripolyphosphate instead of 48.0% thereof; 5% of sodium sulfate, anhydrous, instead of 27.5%; 10% of moisture instead of 5.0%; and 2% of adjuvants (including perfumes instead of enzymes), instead of 1.5%. Also in the present formula is 25% of sodium perborate tetrahydrate. The control is of the same formulation with the exception that the 5% of organophosphorus esters is replaced by 5% of ethoxylated nonylphenol having an ethylene oxide:nonylphenol molar ratio of about 9.5:1. Comparative test results are substantially the same as reported in Example 1, with the compositions being low foaming and of good detergency and anti-redeposition properties but with the experimental formulations being noticeably superior in softening the washed textiles. Such results are also obtainable when the sodium perborate is replaced by sodium sulfate, anhydrous, although the bleaching effect will be lost. Similarly, when the pentasodium tripolyphosphate is replaced by other sequestrants or builder salts, such as sodium citrate and sodium gluconate, in combination with smaller proportions of EDTA, good washing properties are obtained and the wash is softened and made "anti-static". Various other changes in the formulations, within the described ranges of constituents and proportions also result in useful cleaning and softening with the compositions and methods of the present invention, superior to those of control compositions from which the organophosphorus esters are omitted.

EXAMPLE 5

A composition like that of Example 3 is made with the organophosphorus esters being of the mix described in Example 2 and with the sodium tallow soap from distilled tallow fatty acids being replaced with sodium hydrogenated tallow soap. When tested as described with respect to Example 3 essentially the same results are obtained.

EXAMPLE 6

| | Parts |
|---|---|
| Sodium linear dodecyl benzene sulfonate | 8.0 |
| *** Higher fatty alcohol polyethoxyethanol | 3.0 |
| $R^1O(CH_2CH_2O)_2PO(ONa)_2$ | 1.6 |
| $[R^1O(CH_2CH_2O)_2]_2POONa$ | 1.2 |
| $R^2OPO(ONa)_2$ | 0.7 |
| $(R^2O)_2POONa$ | 0.5 |
| Sodium silicate ($Na_2O:SiO_2$ = 1:2) | 5.0 |
| Sodium tripolyphosphate | 42.0 |
| Sodium perborate tetrahydrate | 25.0 |
| Sodium sulfate | 5.0 |
| Sodium carboxymethyl cellulose | 0.5 |
| Ethylene diamine tetraacetic acid, tetrasodium salt | 0.2 |
| Adjuvants | 2.3 |
| Water | 5.0 |

*** Higher fatty alkanol of 16 to 18 carbon atoms;EtO:higher fatty alcohol molar ratio = 50:1.

The detergent composition is made in the manner described in the previous examples. It is employed to wash three kilograms (6.6 lbs.) of normally soiled laundry in a horizontal axis automatic washing machine, the Miele "421" deluxe model, using cycle No. 1, employing a pre-wash with 140 grams (five ounces) of detergent composition and then a main wash, with another 140 grams of detergent, in a five gallon (19 liters) tub. The laundry washed, a mixture of cottons, cotton-synthetic blends and synthetics, washes clean and is noticeably softer than a control composition washed with a commercial laundry detergent. Also, whether the wash water is tap water at 250 p.p.m. hardness, as calcium carbonate, or soft water of 100 p.p.m. hardness, no suds lock is experienced. With a laundry load which is only slightly soiled, the foam heights in the washing machine at the end of the wash are 3 inches (eight cm.) in soft water and 1.5 inches (four cm.) in hard water, both of which are acceptable and do not cause poor detergency.

In another experiment, after twelve washes in a Normalux automatic washing machine with wash water at 85°C., the same temperature as employed for the Miele "421", and at the same laundry: water ratios (about 1:6), concentrations and water hardnesses, when clean cotton test fabrics such as terrycloth and calico are washed, together with soiled cotton, nylon, rayon, polyester-cotton blend and "permanent press" laundry, a significant improvement in softness is noted, compared with a control, a commercial detergent, while the whitening effect is substantially the same.

The above composition is employed under the same conditions but in the washing of laundry in a laundry tub, utilizing about the same time, 10 to 20 minutes, preferably after a pre-soaking of about 1 hour, and satisfactory foaming capability is evidenced. Thus, to produce a foam one has only to agitate the solution weakly. An abundant foam is generated at a temperature of about 60°C. by strong agitation, even when the hardness of the water is as high as 250 p.p.m. Furthermore, the solution is clear, unlike the solution of a control commercial detergent composition, based on anionic and nonionic detergents and higher fatter acid soap, built with sodium tripolyphosphate. Also, when compared with a formula exactly the same except for the replacement of nonionic detergent with sodium tallow soap similar results with respect to foaming, detergency and softening are obtained. However, the "nonionic" formula is curd-free.

In other experiments, the machine and hand washing operations are repeated with formulations having no sodium perborate tetrahydrate, sodium carboxymethyl cellulose or EDTA present and similar results obtain, good softening, controllable foam and excellent detergency. In such formulations the omitted ingredients are replaced with sodium sulfate. If such omitted materials are replaced with sodium silicate similar good effects also result. For non-phosphate (inorganic) formulations the sodium tripolyphosphate is replaced by a mixture of equal parts of sodium silicate and sodium carbonate and an excellent detergent is produced, although the softening effects are not as great, probably due to the carbonate content. If desired, the replacement of sodium tripolyphosphate may be with equal parts of sodium silicate and sodium sulfate, so as to avoid the hardening effects accompanying the inclusion of sodium carbonate.

EXAMPLE 7

The composition of Example 6 is made with the exception that $R^1$ is a mixture of 51% $C_{16}$, 30% $C_{18}$ and 14% $C_{20}$, with the remainder being $C_{14}$ and $C_{22}$. The product resulting is also an effective laundry detergent and has good softening properties. It produces little or no curd during use.

Various other modifications of the preceding formulas are made, with the proportions of materials being varied within the limits given and good detergents are produced having the described properties.

The invention has been described with respect to various illustrations and examples thereof but is not to be limited to them because it will be evident to one of skill in the art how modifications may be made, equivalents employed and substitutes utilized without departing from the spirit or scope of the invention.

What is claimed is:

1. A heavy duty particulate laundry detergent which consists essentially of, by weight:

a. 0.1 to 4% of $R^1O(CH_2CH_2O)_m PO(OM)_2$ b. 0.1 to 3% of $[R^1O(CH_2CH_2O)m]_2POOM$ c. 0.1 to 2% of $R^2OPO(OM)_2$;

d. 0.1 to 1% of $(R^2O)_2POOM$;

wherein, $R^1$ is an alkyl of 14 to 20 carbon atoms, $R^2$ is an alkyl of 6 to 10 carbon atoms,

*m* is from 1 to 6 and

M is alkali metal or ammonium, and wherein the proportions of (a) to (b) and of (c) to (d) are from 4:1 to 2:3, and the proportions of the total of (a) and (b) to the total of (c) and (d) is from 19:1 to 1:1;

e. 10 to 35% of alkali metal or ammonium $C_{11}$-$C_{15}$ alkyl benzene sulfonate;

f. 2 to 50% of an alkali metal silicate having an alkali metal oxide to silicon dioxide ratio from 1:2 to 1:3.2;

g. 10 to 60% of an alkali metal non-silicate builder salt selected from the group consisting of tripolyphosphate, carbonate, bicarbonate, nitrilotriacetate, 2-hydroxy-ethyl nitrilodiacetate, citrate and gluconate; and h. 1 to 15% moisture.

2. A detergent composition according to claim 1 wherein the ranges of proportions of (a) to (b) and of (c) to (d) are 2:1 to 1:1 and of the total of (a) and (b) to the total of (c) and (d) is from 4:1 to 3:2, and which detergent contains from 0.5 to 3% $R^1O(CH_2CH_2O)m PO(OM)_2$, 0.5 to 2% $[R^1O(CH_2CH_2O)m]_2POOM$, 0.5 to 1.5% $R^2OPO(OM)_2$, 0.3 to 1% $(R^2O)_2POOM$, 15 to 30% alkali metal alkyl benzene sulfonate, 4 to 10% alkali metal silicate, 20 to 50% alkali metal tripolyphosphate, 10 to 30% alkali metal sulfate and 5 to 12% moisture.

3. A detergent composition according to claim 1 which comprises about 2% of $R^1O(CH_2CH_2O)$ m-$PO(ONa)_2$, 1.5% of $[R^1O(CH_2CH_2)m]_2POONa$, 0.9% of $R^2OPO(ONa)_2$, 0.6% of $(R^2O)_2POONa$, wherein $R^1$ is a mixture of higher alkyls of 16 and 18 carbon atoms, a major proportion of which is of 16 carbon atoms, *m* is about 2 and $R^2$ is 2-ethyl-n-hexyl, 23% of sodium higher alkyl benzene sulfonate wherein the higher alkyl is of about 12 carbon atoms, 6% of sodium silicate of an $Na_2O:SiO_2$ ratio of about 1:2.4, 30% of sodium tripolyphosphate, 20% of sodium sulfate, 8% of moisture and 8% of adjuvant materials.

4. A heavy duty particulate laundry detergent composition according to claim 1 which includes a total of from 3 to 10% of $R^1O(CH_2CH_2O)m$-$PO(OM)_2$, $[R^1O(CH_2CH_2O)_m]_2POOM$, $R^2OPO(OM)_2$ and $(R^2O)_2POOM$, in proportions resulting from phosphating a mixture of 60 to 95% of $R^1O(CH_2CH_2O)_mOH$ and 40 to 5% of $R^2OH$ to produce from 40 to 70% of monoesters and 60 to 30% of diesters of phosphoric acid, and neutralizing such esters to the alkali metal or ammonium salts thereof.

5. A detergent composition according to claim 3 wherein $R^1$ is a higher alkyl of 16 to 18 carbon atoms, *m* is from 1 to 4, M is sodium, and the detergent contains from 15 to 30% of sodium higher alkyl benzene sulfonate wherein the higher alkyl is of 11 to 15 carbon atoms, 4 to 10% of sodium silicate of $Na_2O:SiO_2$ ratio of from 1:2 to 1:3.2, 20 to 50% sodium tripolyphosphate, 10 to 30% sodium sulfate and 5 to 12% of moisture.

6. A fabric softening, particulate laundry detergent composition which foams when employed for washing by hand and is non-foaming or low foaming when used to wash soiled textiles in a washing machine, which consists essentially of, by weight:

a. 0.1 to 4% of $R^1O(CH_2CH_2O)_mPO(OM)_2$;

b. 0.1 to 3% of $[R^1O(CH_2CH_2O)_m]_2$ POOM;

c. 0.1 to 2% of $R^2OPO(OM)_2$;

d. 0.1 to 1% of $(R^2O)_2POOM$; wherein, $R^1$ is alkyl of 14 to 20 carbon atoms, $R^2$ is an alkyl of 6 to 10 carbon atoms, *m* is from 1 to 6 and M is alkali metal or ammonium;

e. 4 to 12% of alkali metal or ammonium $C_{11}$-$C_{15}$ alkyl benzene sulfonate;

f. 2 to 10% of $RO(CH_2CH_2O)_n H$, wherein R is of 9 to 20 carbon atoms and n is from 5 to 100 or 2 to 10% of $R^3$

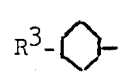

$O(CH_2CH_2O)_sh$ wherein $R^3$ is an alkyl of 7 to 12 carbon atoms and *s* is from 8 to 25, or 2 to 10% of a mixture thereof; and g. 3 to 60% of alkali metal silicate having an alkali metal oxide to silicone dioxide ratio of from 1:1.5 to 1:3.2;

h. 2 to 50% of alkali metal non-silicate builder salt selected from the group consisting of tripolyphosphate, carbonate, bicarbonate, nitrilodiacetate, citrate and gluconate;

i. 2 to 50% of alkali metal sulfate filler; and wherein, (1) the total of (a) – (f), inclusive, is from 8 to 20%; and (2) the ratio of (e) to the sum of (a), (b), (c), (d) and (f) is from 1:2 to 2;1.

7. A detergent composition according to claim 6 wherein the alkali or ammonium alkyl benzene sulfonate is from 6 to 10% of the composition and the alkyl portion thereof is linear and of 10 to 14 carbons atoms, $RO(CH_2CH_2O)_nH$ is from 2 to 5% of the composition, the total of the organic phosphoric acid esters is from 3 to 7% and m is from 1 to 4, the proportion of alkali metal silicate is 3 to 10% of the composition and the alkali metal thereof is sodium, and the composition includes from 10 to 50% of sodium tripolyphosphate.

8. A detergent composition according to claim 7 which comprises about 8% of sodium linear dodecyl benzene sulfonate, about 3% of $RO(CH_2CH_2O)_{50}H$ wherein R is a mixture of linear alkyls of 16 to 18 carbon atoms, about 1.6% of $R^1O(CH_2CH_2O)_mPO(ONa)_2$ wherein $R^1$ is a mixture of higher alkyls of 16 and 18 carbon atoms, about 1.2% of $[R^1O(CH_2CH_2O)_m]_2POONa$, about 0.7% of $R^2OPO(ONa)_2$, wherein $R^2$ is 2-ethyl-n-hexyl, about 0.5 of $(R^2O)_2POONa$, about 5% of sodium silicate of $Na_2O:SiO_2$ ratio of 1:2, about 42% of sodium tripolyphosphate, about 0.5% of sodium carboxymethyl cellulose, about 0.2% of tetrasodium ethylene diamine tetraacetate, about 25% of sodium perborate tetrahydrate and the balance of the composition including minor proportions of sodium sulfate, adjuvant ingredients and water.

9. A detergent composition according to claim 6 which includes a total of from 3 to 10% of $R^1O(CH_2CH_2O)_mPO(OM)_2$, $[R^1O(CH_2CH_2O)_m]_2$-POOM, $R^2OPO(OM)_2$ and $(R^2O)_2POOM$, in proportions resulting from phosphating a mixture of 60 to 95% of $R^1O(CH_2CH_2O)_mOH$ and 40 to 5% of $R^2OH$ to produce from 40 to 70% of monoesters and 60 to 30% of diesters of phosphoric acid, and neutralizing such esters to the alkali metal or ammonium salts thereof.

10. A detergent composition according to claim 9 wherein $R^1$ is a higher alkyl of 16 to 18 carbon atoms, m is from 1 to 4, M is sodium and the detergent contains from 6 to 10% of sodium higher alkyl benzene sulfonate wherein the higher alkyl is linear and of 10 to 14 carbon atoms, 2 to 5% of $RO(CH_2CH_2O)_nH$ wherein R is of 16 to 18 carbon atoms and n is from 10 to 70, 3 to 7% total of the organic phosphoric acid esters as their sodium salts, 3 to 10% of sodium silicate of $Na_2O:SiO_2$ ratio of about 1:2 and 10 to 50% of non-silicate builder salt.

11. A heavy duty particulate laundry detergent which softens textiles washed with it, which consists essentially of, by weight:

a. 0.1 to 4% of $R^1O(CH_2CH_2O)_m$ $PO(OM)_2$ ;

b. 0.1 to 3% of $[R^1)(CH_2CH_2O)_m]2$ POOM ;

c. 0.1 to 2% of $R^2OPO(OM)_2$ ;

d. 0.1 to 1% of $(R^2O)_2$ POOM ;

wherein, $R^1$ is an alkyl of 14 to 20 carbon atoms, $R^2$ is an alkyl of 6 to 10 carbon atoms,

*m* is from 1 to 6 and

M is alkali metal or ammonium, and wherein the proportions of (a) to (b) and of (c) to (d) are from 4:1 to 2:3 , and the proportion of the total of (a) and (b) to the total of (c) and (d) is from 19:1 to 1:1 ;

e. 1 to 8% of alkali metal or ammonium $C_{11}$-$C_{15}$ alkyl benzene sulfonate ;

f. 2 to 12% of alkali metal $C_{10}$-$C_{20}$ fatty acid soap ;

g. 2 to 50% of alkali metal silicate having an alkali metal oxide to silicon dioxide ratio from 1:2 to 1:3.2 ;

h. 10 to 60% of alkali metal non-silicate builder salt selected from the group consisting of tripolyphosphate, carbonate, bicarbonate, nitrilodiacetate, citrate and gluconate:

i. 3 to 50% of alkali metal sulfate; and j. 2 to 15% moisture.

12. A detergent composition according to claim 11 wherein the ranges of proportions of (a) to (b) and of (c) to (d) are 2:1 to 1:1 and of the total of (a) and (b) to the total of (c) and (d) is from 4:1 to 3:2 ; and which detergent contains from 0.5 to 3% $R^1O(CH_2CH_2O)_m$-$PO(OM)_2$, 0.5 to 2% $[R^1O(CH_2CH_2O)_m]2$- POOM, 0.5 to 1.5 $R^2OPO(OM)_2$, 0.3 to 1% $(R^2O)_2POOM$, 2 to 5% alkali metal or ammonium higher alkyl benzene sulfonate, 3 to 10% alkali metal soap of higher fatty acids of 16 to 18 carbon atoms, 4 to 12% alkali metal silicate, 25 to 60% alkali metal tripolyphosphate, 3 to 25% alkali metal sulfate and 2 to 12% of moisture.

13. A detergent composition according to claim 11 which comprises about 2% of $R^1O(CH_2CH_2O)_mPO(ONa)_2$, 1.5% of $[R^1O(CH_2CH_2O)_m]_2POONa$, 0.9% of $R^2OPO(ONa)_2$, 0.6% of $(R^2O)_2POONa$, wherein $R^1$ is a mixture of higher alkyls of 16 to 18 carbon atoms, a major proportion of which is of 16 carbon atoms, m is about 2.0 and $R^2$ is 2-ethyl-n-hexyl, 4.5% of sodium soap of distilled tallow fatty acids, 2.5% of sodium alkyl benzene sulfonate wherein the alkyl group is linear dodecyl, 48% pentasodium tripolyphosphate, 6% of sodium silicate of $Na_2O:SiO_2$ ratio of about 1:2.4, 6% of sodium sulfate, 5% of moisture, 21.5% of sodium perborate and 1.5% of adjuvant materials.

14. A detergent composition according to claim 11 which comprises about 2% of $R^1O(CH_2CH_2O)_mPO(ONa)_2$, 1.5% of $[R^1O(CH_2CH_2O)_m]_2POONa$, 0.9% of $R^2OPO(ONa)_2$, 0.6% of $(R^2O)_2POONa$, wherein $R^1$ is a mixture of higher alkyls of 16 and 18 carbon atoms, m is about 2.0 and $R^2$ is 2-ethyl-n-hexyl, 4.5% of sodium hydrogenated tallow soap, 2.5% of sodium alkyl benzene sulfonate wherein the alkyl group is linear dodecyl, 48% pentasodium tripolyphosphate, 6% of sodium silicate of $Na_2O:SiO_2$ ratio of about 1:2.4, 6% of sodium sulfate, 5% of moisture, 21.5% of sodium perborate and 1.5% of adjuvant materials.

15. A detergent composition according to claim 11 which comprises about 2% of $R^1O(CH_2CH_2O)_mPO(ONa)_2$, 1.5% of $[R^1O(CH_2CH_2O)_m]_2POONa$, 0.9% of $R^2OPO(ONa)_2$, 0.6% of $(R^2O)_2POONa$, wherein $R^1$ is a mixture of higher alkyls of 16 to 18 carbon atoms, a major proportion of which is of 16 carbon atoms, *m* is about 2.0 and $R^2$ is 2-ethyl-n-hexyl, 7% of sodium tallow fatty acids soap, 3% of sodium alkyl benzene sulfonate wherein the alkyl group is linear dodecyl, 35% sodium tripolyphosphate, 8% sodium silicate, 10% moisture, 25% sodium perborate tetrahydrate, 5% sodium sulfate and 2% adjuvants.

16. A heavy duty particulate laundry detergent composition according to claim 11 which includes a total of from 3 to 10% of $R^1O(CH_2CH_2O)_m$-$PO(OM)_2$, $[R^1O(CH_2CH_2O)_m]_2POOM$, $R^2OPO(OM)_2$ and $(R^2O)_2POOM$, in proportions resulting from phosphating a mixture of 60 to 95% of $R^1O(CH_2CH_2O)_mOH$ and 40 to 5% of $R^2OH$ to produce from 40 to 70% of monoesters and 60 to 30% of diesters of phosphoric acid, and neutralizing such esters to the alkali metal or ammonium salts thereof.

* * * * *